US007686172B2

(12) United States Patent
Wisnoski et al.

(10) Patent No.: US 7,686,172 B2
(45) Date of Patent: Mar. 30, 2010

(54) STORAGE BIN

(75) Inventors: John R. Wisnoski, Haubstadt, IN (US); Amy L. Stevenson, Ft. Branch, IN (US); Wyatt A. Cline, Niles, MI (US); Todd C. Starr, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 435 days.

(21) Appl. No.: 11/057,799

(22) Filed: Feb. 14, 2005

(65) Prior Publication Data

US 2006/0180561 A1 Aug. 17, 2006

(51) Int. Cl.
*A47F 5/08* (2006.01)

(52) U.S. Cl. ..... 211/94.01

(58) Field of Classification Search ..... 211/94.01, 211/88.01, 11, 50, 10, 71.01; D25/58, 121, D25/122, 123, 138; 52/36.5
See application file for complete search history.

(56) References Cited

U.S. PATENT DOCUMENTS 3,045,961 A * 7/1962 Cygan ..... 248/222.12
3,486,634 A * 12/1969 Frater ..... 211/128.1
3,698,565 A * 10/1972 Weber ..... 211/87.01
3,804,067 A * 4/1974 Lehe et al. ..... 119/529
RE28,834 E * 6/1976 Johnson ..... 119/529
4,015,713 A * 4/1977 Clipson et al. ..... 206/509
4,618,192 A * 10/1986 Kelley ..... 312/245
4,817,900 A * 4/1989 Whittington et al. ... 248/223.41
D301,424 S * 6/1989 Beirise et al. ..... D6/574
D310,103 S * 8/1990 Beirise et al. ..... D19/67
5,379,976 A * 1/1995 DeGirolamo ..... 248/220.43
5,775,521 A * 7/1998 Tisbo ..... 211/94.01
6,123,154 A * 9/2000 MacDonald et al. ..... 169/37
6,612,527 B1 * 9/2003 Nagel ..... 248/220.43
6,811,043 B2 * 11/2004 Perkins et al. ..... 211/94.01
7,527,156 B2 * 5/2009 Wisnoski et al. ..... 211/70.6

* cited by examiner

*Primary Examiner*—Sarah Purol
(74) *Attorney, Agent, or Firm*—Tara M. Hartman; Robert L. Judd

(57) ABSTRACT

A storage bin for use in conjunction with slotwall panel storage systems that can be stacked and snapped together or hung on a slotwall or slot track storage system. The storage bin includes a downwardly opening J-shaped hook and one or more upwardly opening J-shaped hooks extending from the rear wall of the storage bin. When the storage bin is engaging the top edge of the slat the upwardly opening J-shaped hook or hooks can extend into the slot forming the bottom edge of a slat without engaging the bottom edge of the slat.

19 Claims, 5 Drawing Sheets

STORAGE BIN

BACKGROUND OF THE INVENTION

The invention relates to small storage bins that can be removably mounted on a slat storage system and can be snapped together for stacking.

Plastic storage bins are widely available in a variety of sizes and configurations for storage of a wide variety of materials for home, commercial and industrial use. Small item storage bins are convenient for storing small tools and a wide variety of fasteners including but not limited to screws, nails, bolts, nuts, washers, anchors and other mechanical or electrical devices commonly used in a workshop environment. Plastic storage bins that snap together for stacking are known. Also, plastic storage bins that hang on a rail or perforated mounting board are known.

SUMMARY OF THE INVENTION

The invention relates to a storage device for movable and removable mounting on a member having at least one slat defined by spaced apart slots. The storage device includes a wall having a downwardly opening J-shaped hook extending in a rearward direction from the wall along at least a portion of the wall to hook over the top edge of a slat. At least one upwardly opening J-shaped hook extends in a rearward direction from the wall spaced below the downwardly opening J-shaped hook to extend into the slot forming the bottom edge of the slat.

The upwardly opening J-shaped hook can extend into the slot forming the bottom edge of the slat without engaging the bottom edge of the slat when the downwardly opening J-shaped hook engages the top edge of the slat.

The wall can be the rear wall of a bin having opposed sidewalls connected to the rear wall, a bottom wall connected to the rear wall and the sidewalls, and a front wall connected to the bottom wall and the sidewalls.

A first portion of the top edge of the sidewalls can have an outwardly extending inwardly opening step that extends from the top edge of the rear wall toward the front wall. The inwardly opening step can include a plurality of ribs extending inwardly from the top edge of the inwardly opening steps. The bottom wall can include a plurality of feet having a projection extending outwardly from the sidewall. The plurality of ribs on the top edge of the inwardly opening steps can engage the plurality of projections on the feet to connect two storage devices when two storage devices are stacked and snapped together.

In another aspect the invention relates to a storage bin arranged for removable mounting on a member having at least one slat defined by spaced apart slots. The storage bin includes a bottom wall, a rear wall extending upwardly from the bottom wall and having a downwardly opening J-shaped hook on the top edge of the rear wall. The downwardly opening J-shaped hook includes a horizontal wall extending in a rearward direction from the rear wall and a vertical wall extending downwardly from the distal end of the horizontal wall to form a hook to hook over the top edge of a slat. The rear wall also has a pair of upwardly opening J-shaped hooks including a base extending in a rearward direction from the rear wall and an upwardly extending hook at the distal end of the base. The upwardly opening J-shaped hooks can be positioned adjacent opposite edges of the rear wall spaced below the downwardly opening J-shaped hook and above the bottom edge of the rear wall to extend into the slot forming the bottom edge of a slat. The storage bin also includes a pair of sidewalls extending upwardly from the bottom wall having an outwardly extending inwardly opening step extending along a first portion of the top edge of the sidewalls from the top edge of the rear wall toward the front wall. The sidewalls have an outwardly extending sidewall flange extending along a second portion of the top edge of the sidewalls from the top of the inwardly opening step toward the front of the sidewall. An outwardly curved front wall extends upwardly an angle greater than 90° from the bottom wall a vertical height less than the height of the rear wall. The front wall includes an outwardly extending front wall flange at the top of the front wall and a downwardly extending handle extending across the front wall having rearwardly extending legs at the ends of the handle that engage the sidewalls and the outwardly extending flanges on the second portion of the sidewalls. The upwardly opening J-shaped hooks extend into the slot forming the bottom edge of a slat without engaging the bottom edge of the slat when the downwardly opening J-shaped hook engages the top edge of the slat.

DESCRIPTION OF THE INVENTION

Storage bins according to the invention can be used in conjunction with slotwall panel storage systems as disclosed in U.S. Pat. No. 6,811,043 and with workroom storage systems as disclosed in co-pending U.S. patent application Ser. No. 10/760,168. U.S. Pat. No. 6,811,043 and co-pending U.S. patent application Ser. No. 10/760,168 are incorporated by reference. Storage bins according to the invention allow a user to store and organize small parts and tools at their fingertips. Storage bins according to the invention can be stacked and snapped together or hung on a slotwall or slot track storage system and can be formed of durable material suitable for use in a garage or workshop environment.

Figure 1:
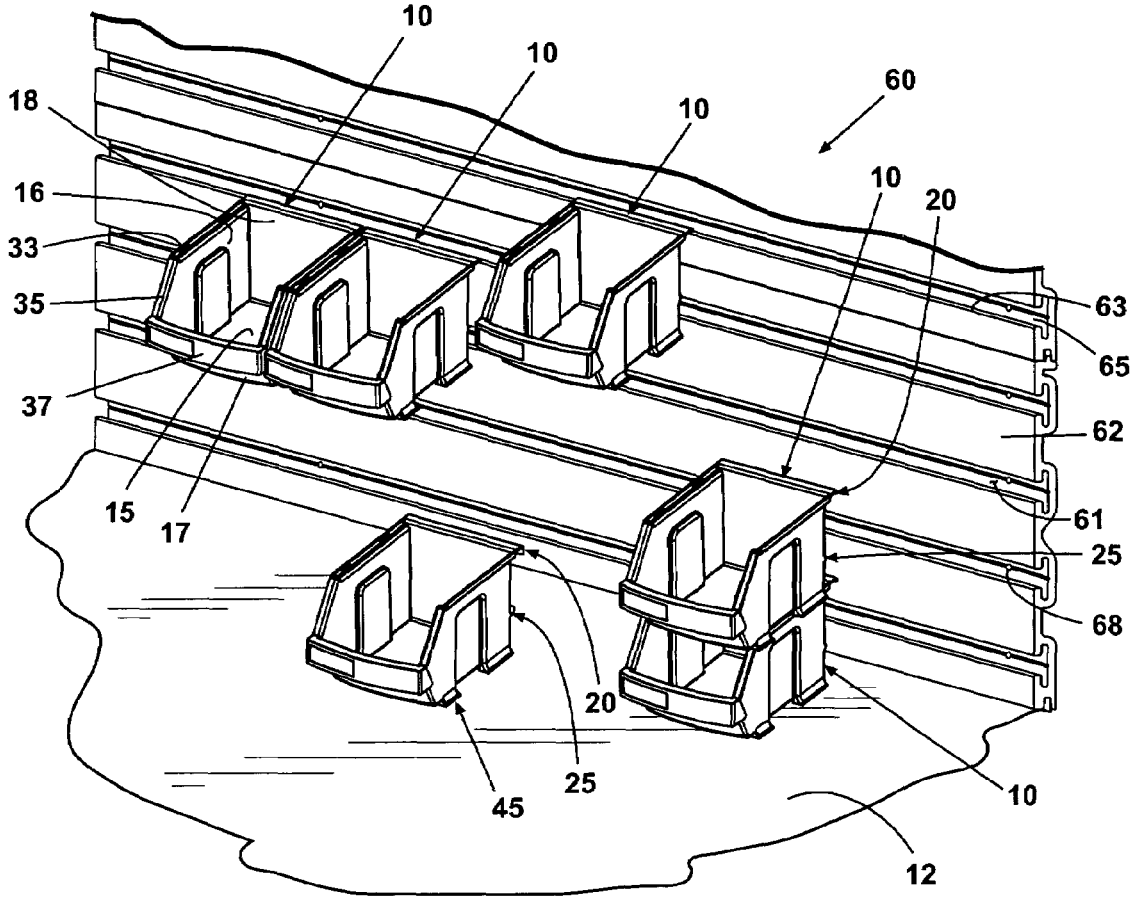
FIG. 1 is a perspective view illustrating storage bins according to the invention positioned on a slotwall panel, stacked on a work surface and used individually.

Turning to FIG. 1, several storage bins can be seen utilized in the several modes of use contemplated by the invention.

Storage bins 10 can be seen removably mounted on slotwall panel 60, stacked on modular workbench 12 or individually placed on modular workbench 12. Slotwall panel 60 is described in detail in U.S. Pat. No. 6,811,043 and in co-pending U.S. patent application Ser. No. 10/760,168. Modular workbench 12 is described in detail in U.S. patent application Ser. No. 10/760,168. Slotwall panels 60 can be mounted to a wall with a plurality of fasteners 68. While storage bins 10 are disclosed in conjunction with slotwall and slot track storage systems as described in U.S. Pat. No. 6,811,043 and co-pending U.S. patent application Ser. No. 10/760,168, those skilled in the art will understand that storage bins 10 are not limited to use with slotwall and slot track storage systems disclosed in the referenced patent and patent application. Similarly, storage bins according to the invention are not limited to use with the modular workbench disclosed in co-pending U.S. patent application Ser. No. 10/760,168.

Figure 2:
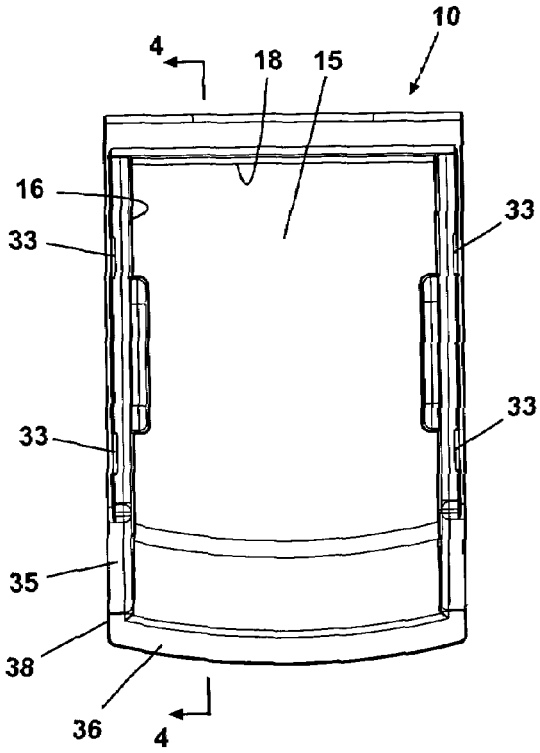
FIG. 2 is a top view of a storage bin according to the invention.
Figure 3:
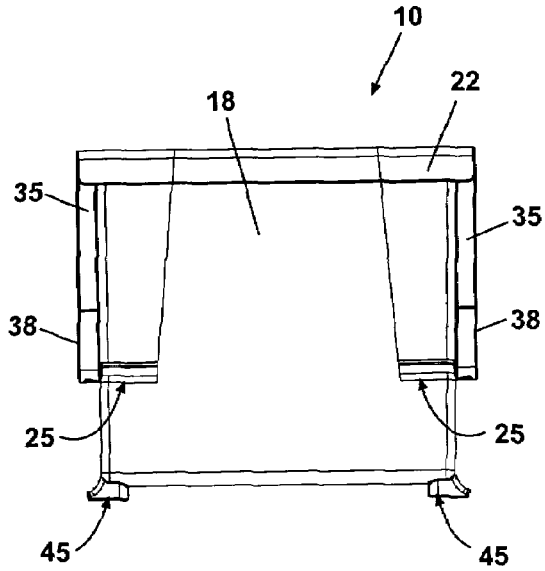
FIG. 3 is a rear view of a storage bin according to the invention.
Figure 4:
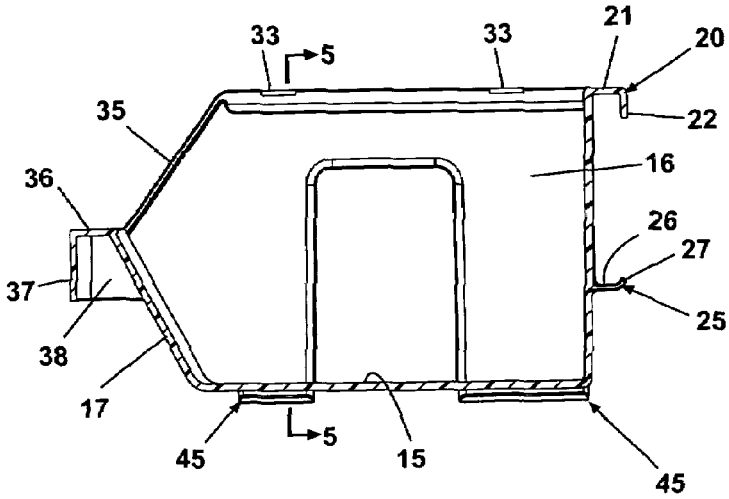
FIG. 4, is a sectional view of the storage bin along line 4-4 in FIG. 2.
Figure 5:
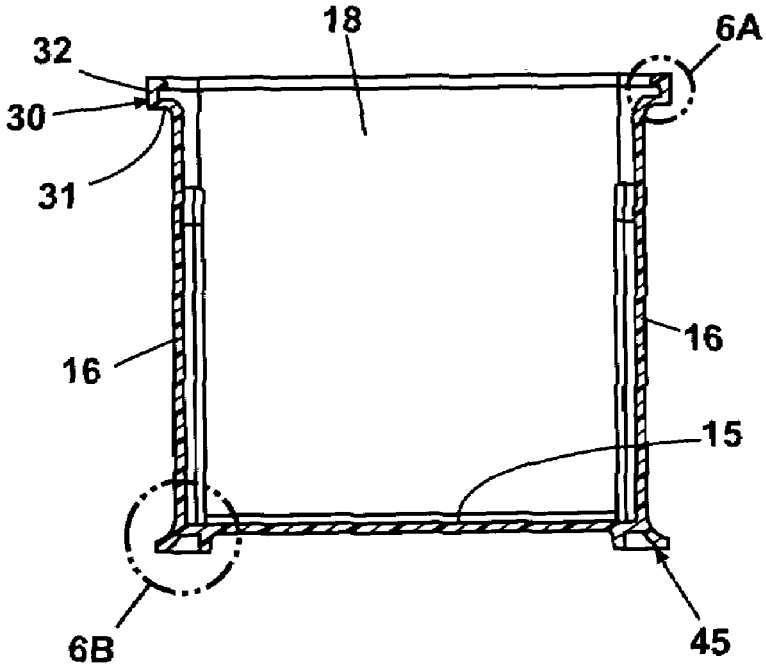
FIG. 5, is a sectional view of the storage bin along line 5-5 in FIG. 4.
Figure 6A:
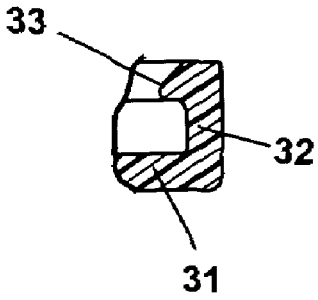
FIG. 6A is an enlarged portion of the storage bin at detail 6A in FIG. 5.
Figure 6B:
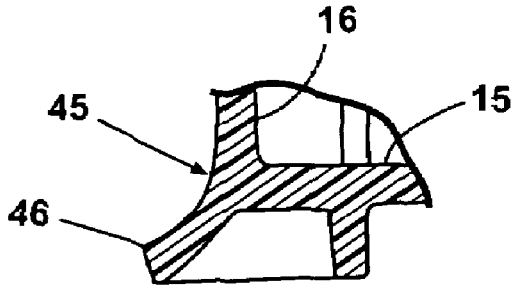
FIG. 6B is an enlarged portion of the storage bin at detail 6B in FIG. 5.

Turning to FIGS. 1 through 7, a storage bin 10 according to the invention can include a bottom wall 15, a pair of sidewalls 16, a front wall 17 and a rear wall 18. A downwardly extending J-shaped hook 20 can be provided at the top edge of rear wall 18 and can include a horizontal wall 21 and a vertical wall 22 extending downwardly from the distal end of horizontal wall 21. Horizontal wall 21 can extend rearwardly from the top edge of rear wall 18. Downwardly extending J-shaped hook 20 can be dimensioned to easily fit over the edge 63 of a slat 62 of a slotwall storage system 60, see FIG. 1 and FIGS. 7A-7C. The length of horizontal wall 21 can be greater than the thickness of slat 62 defined by undercut 64 between slat 62 and bottom wall 65. One or more upwardly opening J-shaped hooks 25 can be provided on rear wall 18 spaced from downwardly opening J-shaped hook 20. Upwardly opening J-shaped hook 25 can include a base 26 extending rearwardly from rear wall 18 and can have a hook 27 extending upwardly from the distal end of base 26. Hook 27 can extend upwardly enough to assure that upwardly extending J-shaped hook 25 does not easily slide past the bottom edge 63 of a slat 62 when a storage bin in bumped vertically as shown and described in connection with FIG. 7C below. As shown in FIG. 3 two upwardly opening J-shaped hooks 25 can be provided, one on each edge of rear wall 18. The upwardly opening J-shaped hook 25 can be positioned on rear wall 18 so that the upwardly opening J-shaped hooks 25 including hooks 27 can extend into the slot 61 forming the slat 62 on which storage bin 10 is positioned without engaging the bottom edge 63 of slat 62, see FIG. 7A. By spacing upwardly opening J-shaped hooks 25 so that base 26 and hook 27 do not engage the bottom edge of a slat 62 when the storage bin 10 is positioned on a slotwall panel 60, a storage bin 10 can easily be positioned and moved on the slotwall panel 60 since only the downwardly opening J-shaped hook 20 is in contact with a slat 62. Downwardly opening J-shaped hook 20 is shown in this embodiment as extending substantially the full width of storage bin 10. Those skilled in the art will readily understand that downwardly opening J-shaped hook 20 can extend less than the full width of rear wall 18, or can be formed in two or more segments if desired. Similarly, one, more than two or a continuous strip upwardly opening J-shaped hook 25 can be provided on rear wall 18 if desired. Applicants have found that a single substantially full width downwardly opening J-shaped hook 20 and two upwardly opening J-shaped hooks 25 as shown in FIGS. 1-7 perform well.

Storage bin 10 can have a front wall 17 that can extend upwardly from bottom wall 15 at an angle greater than 90°. In the embodiment shown in FIGS. 1-6 front wall 17 can extend upwardly from bottom wall 15 at approximately 120°. Those skilled in the art will readily understand that the front wall 17 can extend upwardly at an angle more or less than approximately 120° if desired. Front wall 17 can extend approximately half the vertical distance that rear wall 18 extends to facilitate access to items stored in storage bin 10, particularly when storage bins are stacked. As shown in FIG. 2, front wall 17 can be curved to bow outwardly between sidewalls 16, again to facilitate access to items stored in the storage bin. Front wall 17 can include a handle 37 positioned at the distal end of front wall flange 36. Handle 37 can have a legs 38 connecting the ends of handle 37 with sidewalls 16.

Storage bins 10 can include a step 30 along a first portion of the top edge of sidewalls 16. Step 30 can extend forwardly from rear wall 18 toward front wall 17. Step 30 can be formed by a horizontal leg 31 extending outwardly from the top edge of the first portion of sidewalls 16 and a vertical leg 32 extending upwardly from the distal end of horizontal leg 31. Storage bins 10 can include an outwardly extending flange 35 along a second portion of sidewalls 16. Outwardly extending flanges 35 can extend from the top of the inwardly opening step 30 toward the front of the sidewall. The second portion of the sidewall 16 and outwardly extending flange 35 can slope downwardly to front wall flange 36.

Feet 45 can be provided on the bottom wall 15 to support storage bin 10 on a work surface 12. Feet 45 can include a projection 46 extending outwardly from the sidewall 16. Step 30 can include a plurality of ribs 33 at the top edge of vertical leg 32. Ribs 33 can be positioned to align with feet 45 so that ribs 33 can engage projections 46 to retain a storage bin 10 stacked on a storage bin. Vertical legs 32 of steps 30 can be spaced to accommodate the bottom wall 15 including feet 45 and projections 46 of a storage bin 10 for stacking. Projections 46 can be arranged to snap under ribs 33 allowing two or more storage bins to be snapped together in stacked fashion. Those skilled in the art will understand that the ribs 33 and projections 46 can be dimensioned so that storage bins can be connected together securely enough that a user can pick up a stack of two or more storage bins containing stored articles by picking up the top storage bin, but yet be capable of being snapped apart without undue force.

Figure 7C:
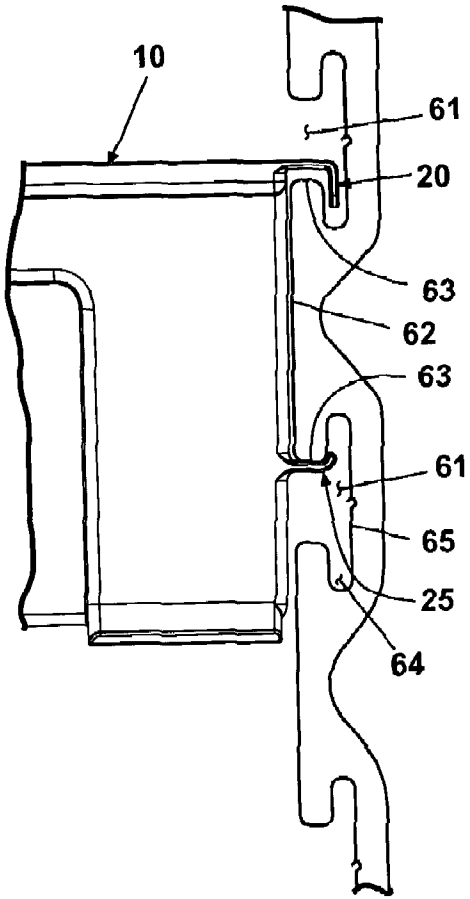
FIG. 7C is a perspective view of a storage bin on a slotwall panel that has been pushed up vertically illustrating how the storage bin stays on the slotwall panel when the storage bin is displaced generally vertically.
Figure 7B:
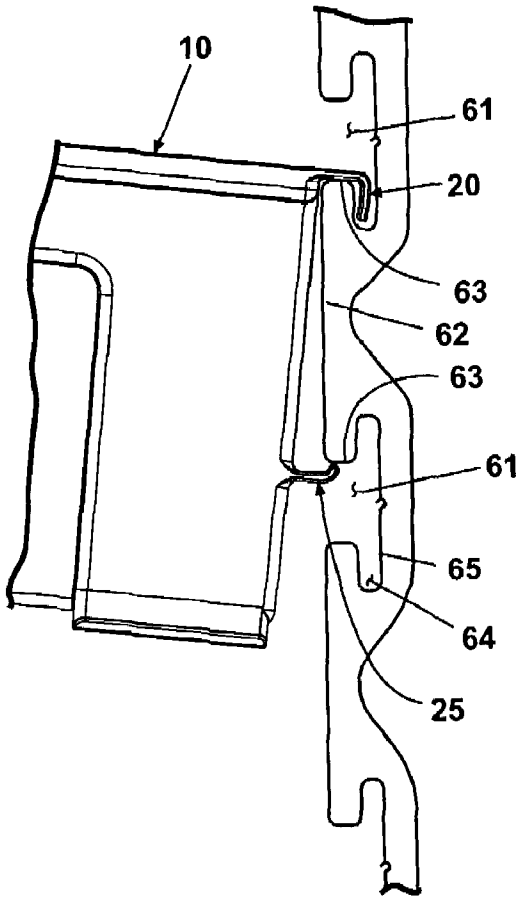
FIG. 7B is a perspective view of a storage bin on a slotwall panel that has been tipped up at the front of the bin illustrating how the storage bin stays on the slotwall panel when the front edge of the storage bin is displaced upwardly.
Figure 7A:
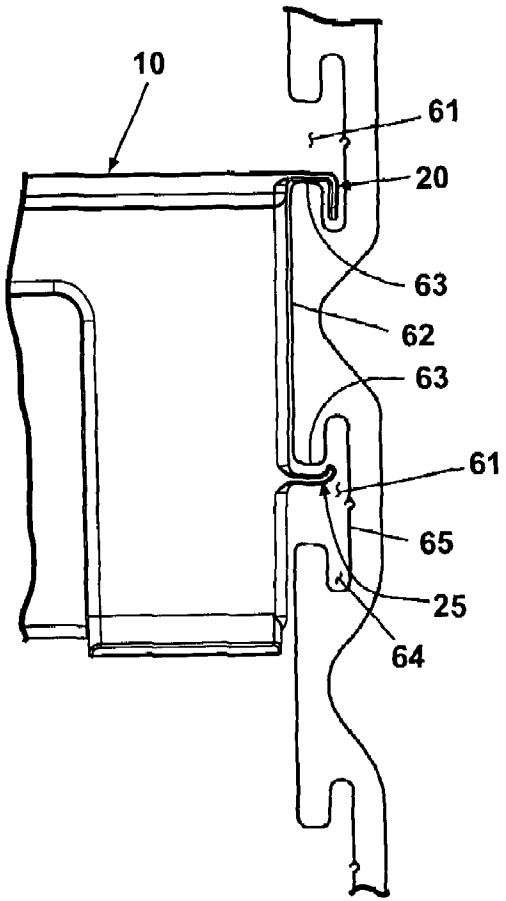
FIG. 7A is perspective view illustrating a storage bin installed on a slotwall panel.

Turning to FIGS. 7A-7C, a storage bin 10 according to the invention can be positioned on a slotwall panel by placing downwardly opening J-shaped hook 20 over an upper edge 63 of a slat 62. As indicated above, upwardly opening J-shaped hooks 25 can be positioned on rear wall 18 so that upwardly opening J-shaped hook 25 including base 26 and hook 27 can extend into slot 61 without engaging the bottom edge 63 of slat 62. In the event the front edge of a storage bin 10 is bumped or displaced upwardly while installed on a slotwall panel 60 the storage bin 10 can pivot upwardly on downwardly opening J-shaped hook 20 without falling off of the slotwall panel as shown in FIG. 7B. In the event a storage bin 10 is bumped or displaced vertically while installed on a slotwall panel 60, base 26 and hook 27 of upwardly opening J-shaped hook 25 engage the bottom edge 63 of slat 62 before vertical wall 22 of downwardly opening J-shaped hook 20 clears the top edge 63 of slat 62 as shown in FIG. 7C. Thus, once positioned on a slotwall panel 60 a storage bin 10 according to the invention is not easily knocked or bumped off the slotwall panel 60. Yet, a user can easily slide a storage bin 10 along a slat 62. Further, a user can easily remove a storage bin 10 by grasping the handle 37 or sidewalls 16 and pivoting the storage bin 10 to allow upwardly opening J-shaped hook 25 to clear slat 62 and then lifting the storage bin 10 off the slotwall panel 60. Thus, a storage bin according to the invention can be easily installed, moved along or removed from a slotwall panel storage system. Yet a storage bin according to the invention is securely retained to resist inadvertent removal should storage bin 10 be bumped by a person using an adjacent work surface 12 or handling another storage bin 10 positioned on the slotwall panel.

Figure 8:
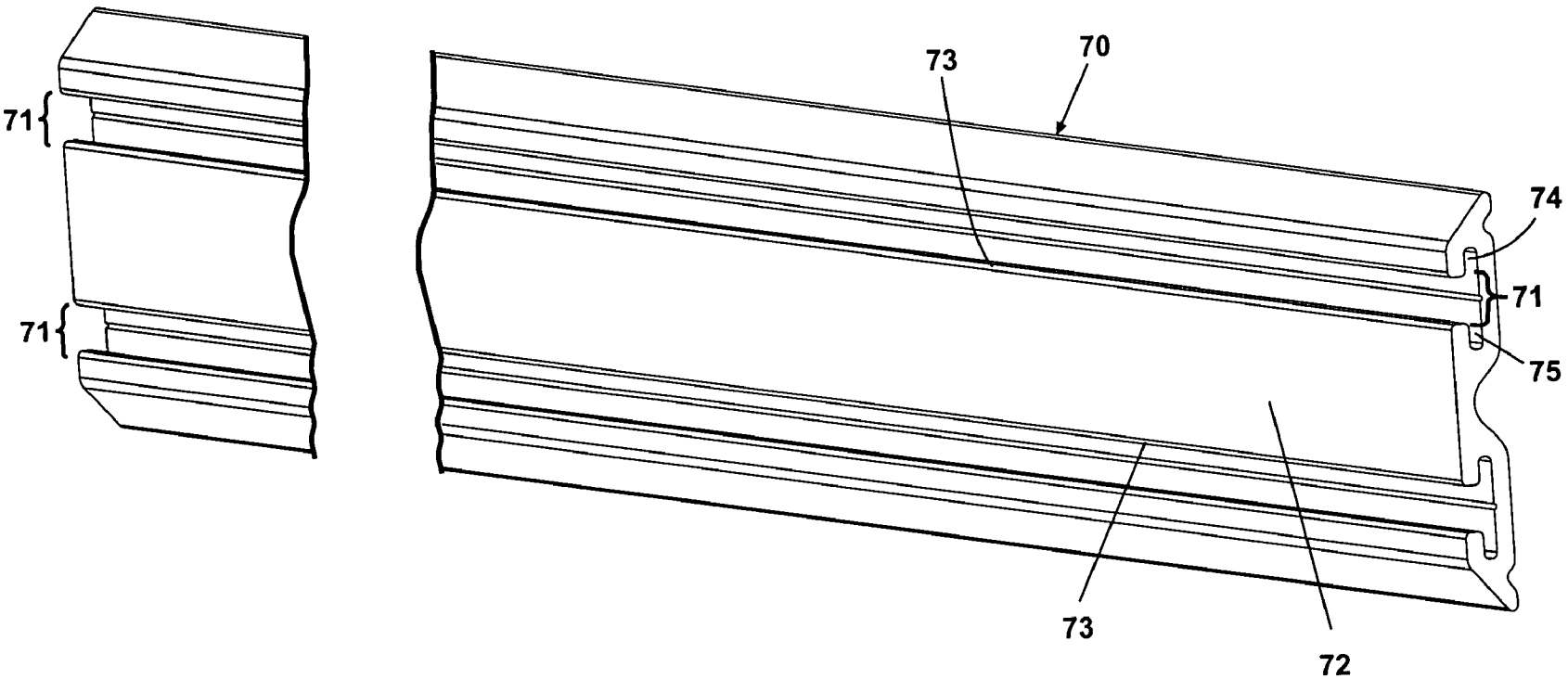
FIG. 8 is a perspective view of a slot track that can be used for removable mounting of storage bins according to the invention.

Turning to FIG. 8, a storage bin according to the invention can be mounted on a slot track storage system. Slot track 70 can be similar to the slot track disclosed in co-pending U.S. patent application Ser. No. 10/760,168 referred to above. Slot track 70 can include slots 71 that can form a slat 72 having edges 73. Slat 72 can be formed by undercuts 74 and bottom wall 75. In operation, a storage bin according to the invention can be positioned on a slot track 70 in the same way a storage bin can be positioned on a slotwall panel as described above. Slot tracks 70 can be mounted to a wall using fasteners similar to slotwall panels 60 as described above.

Storage bin 10 can be formed of polypropylene to be suitable for use in a garage or workshop environment. Those skilled in the art will understand that other plastic materials can be used such as high density polyethylene. Plastic material used for the storage bins according to the invention can be exposed to a wider range of temperatures than normally encountered inside a house, commercial or industrial facility.

While the invention has been specifically described in connection with certain specific embodiments thereof, it is to be understood that this is by way of illustration and not of limitation, and the scope of the appended claims should be construed as broadly as the prior art will permit.

We claim:

1. A storage device for movable and removable mounting on a generally vertical slotwall panel having at least one slat having a top and bottom edge defined by spaced apart slots comprising:

a wall;

a downwardly opening J-shaped hook extending in a rearward direction from the wall along at least a portion of the wall to hook over the top edge of a slat;

at least one upwardly opening J-shaped hook extending in a rearward direction from the wall and spaced below the downwardly opening J-shaped hook to extend into the slot forming the bottom edge of a slat, wherein the upwardly opening J-shaped hook extends into the slot forming the bottom edge without engaging the bottom edge when the downwardly opening J-shaped hook engages the top edge;

where, in the event the storage device is bumped or displaced vertically the upwardly opening J-shaped hook engages the bottom edge before the downwardly opening J-shaped hook disengages from the top edge, and in the event the storage device is bumped or displaced pivotally upward the storage device can pivot on the downwardly opening J-shaped hook without falling off the slotwall panel to assure the storage device is not knocked or bumped off the slotwall panel, while allowing the storage device to be easily slid along or removed from a slat.

2. The storage device according to claim 1, wherein the downwardly opening J-shaped hook extends along the top edge of the wall.

3. The storage device according to claim 2, wherein the downwardly opening J-shaped hook extends substantially the full width of the wall.

4. The storage device according to claim 1, wherein the at least one upwardly opening J-shaped hook is spaced upwardly from the bottom edge of the wall.

5. The storage device according to claim 4, wherein there is an upwardly opening J-shaped hook adjacent opposite edges of the wall.

6. The storage device according to claim 1, wherein the wall comprises a rear wall of a bin, the bin comprising the rear wall, opposed sidewalls connected to the rear wall, a bottom wall connected to the rear wall and the sidewalls, and a front wall connected to the bottom wall and the sidewalls.

7. The storage device according to claim 6, wherein the front wall extends upwardly at an angle greater than 90° from the bottom wall.

8. The storage device according to claim 7, wherein the front wall extends vertically less than the height of the rear wall.

9. The storage device according to claim 8, wherein the front wall is curved outwardly.

10. The storage device according to claim 6, wherein a first portion of the top edge of the sidewalls comprises an outwardly extending inwardly opening step.

11. The storage device according to claim 10, wherein the inwardly opening step extends from the top edge of the rear wall toward the front wall.

12. The storage device according to claim 11, wherein a second portion of the top edge of the sidewalls comprises an outwardly extending flange extending from the top of the inwardly opening step downwardly to the front wall.

13. The storage device according to claim 11, wherein the inwardly opening step includes a plurality of ribs extending inwardly from the top edge of the inwardly opening steps.

14. The storage device according to claim 13, wherein the bottom wall includes a plurality of feet having a projection extending outwardly from the sidewall.

15. The storage device according to claim 14, wherein the plurality of ribs on the top edge of the inwardly opening steps engage the plurality of projections on the feet to connect two storage devices when two storage devices are stacked and snapped together.

16. The storage device according to claim 12, wherein the front wall comprises a forwardly extending flange from the top edge of the front wall and a downwardly extending handle extending across the front wall.

17. The storage device according to claim 16, wherein the handle comprises rearwardly extending legs at the ends of the handle that engage the sidewalls and the outwardly extending flanges on the second portion of the sidewalls.

18. A storage bin arranged for movable and removable mounting on a member having at least one slat having a top and bottom edge defined by spaced apart slots comprising:

a bottom wall;

a rear wall extending upwardly from the bottom wall and having a downwardly opening J-shaped hook including a horizontal wall extending in a rearward direction from the top edge of the rear wall and a vertical wall extending downwardly from the distal end of the horizontal wall to form a hook to hook over the top edge of a slat, and having a pair of upwardly opening J-shaped hooks including a base extending in a rearward direction from the rear wall and an upwardly extending hook at the distal end of the base positioned adjacent opposite edges of the rear wall spaced below the downwardly opening J-shaped hook and positioned above the bottom edge of the rear wall to extend into the slot forming the bottom edge of a slat;

a pair of sidewalls extending upwardly from the bottom wall having an outwardly extending inwardly opening step extending along a first portion of the top edge of the sidewalls from the top edge of the rear wall toward the front wall, and having an outwardly extending sidewall flange extending along a second portion of the top edge of the sidewalls from the top of the inwardly opening step toward the front of the sidewall;

an outwardly curved front wall extending upwardly an angle greater than 90° from the bottom wall a vertical height less than the height of the rear wall and including an outwardly extending front wall flange at the top of the front wall and a downwardly extending handle extending across the front wall having rearwardly extending legs at the ends of the handle that engage the sidewalls and the outwardly extending flanges on the second portion of the sidewalls;

wherein the upwardly opening J-shaped hooks extend into the slot forming the bottom edge of a slat without engaging the bottom edge when the downwardly opening J-shaped hook engages the top edge.

19. The storage bin according to claim 18, wherein the inwardly opening step includes a plurality of ribs extending inwardly from the top edge of the inwardly opening steps, and the bottom wall includes a plurality of feet having a projection extending outwardly from the sidewall, and wherein the plurality of ribs on the top edge of the inwardly opening steps engage the plurality of outwardly extending portions of the feet to connect two storage bins when two storage bins are stacked and snapped together.

* * * * *